US006746721B1

(12) United States Patent
Moser

(10) Patent No.: US 6,746,721 B1
(45) Date of Patent: Jun. 8, 2004

(54) POLAR POLYMERIC COATING

(75) Inventor: Eva Maria Moser, Binz (CH)

(73) Assignee: Eidgenossische Materialprufungs-Und Forschungsanstalt EMPA (SE)

( * ) Notice: Subject to any disclaimer, the term of this patent is extended or adjusted under 35 U.S.C. 154(b) by 0 days.

(21) Appl. No.: 09/601,709

(22) PCT Filed: Feb. 5, 1999

(86) PCT No.: PCT/CH99/00050

§ 371 (c)(1),
(2), (4) Date: Aug. 2, 2000

(87) PCT Pub. No.: WO99/39842

PCT Pub. Date: Aug. 12, 1999

(30) Foreign Application Priority Data

Feb. 5, 1998 (CH) ..... 0281/98

(51) Int. Cl.[7] ..... B22F 3/26
(52) U.S. Cl. ..... 427/488; 427/569
(58) Field of Search ..... 427/488, 569

(56) References Cited

U.S. PATENT DOCUMENTS 3,397,132 A 8/1968 Wolinski
4,312,575 A 1/1982 Peyman et al.
4,693,927 A * 9/1987 Nishikawa et al. ..... 428/216

FOREIGN PATENT DOCUMENTS

| | | |
|---|---|---|
| DE | 39 08 418 | 9/1990 |
| DE | 41 14 805 | 6/1993 |
| DE | 42 34 521 | 2/1994 |
| EP | 0 593 988 | 4/1994 |
| WO | 92/10310 | 6/1992 |
| WO | 96/18498 | 6/1996 |
| WO | 97/01656 | 1/1997 |

* cited by examiner

*Primary Examiner*—Bernard Pianalto
(74) *Attorney, Agent, or Firm*—Bachman & Lapointe, P.C.

(57) ABSTRACT

The coating of substrates, particularly polymers and ceramic or metal substrate, for the production of a polar, polymeric coating is conducted by plasma polymerization. The process gas used for this purpose is free from water or water vapor and contains at least one organic compound, in addition to an inorganic gas and/or carbon monoxide and/or carbon dioxide and/or ammonium and/or nitrogen and/or another gas containing nitrogen.

4 Claims, 4 Drawing Sheets

| Sample/Film | Power[W] | $CO_2$ [sccm] | $CH_4$ [sccm] | Ar [sccm] | $O_2$ [sccm] | $C_2H_2$ [sccm] | $NH_3$ [sccm] | Thickness [nm] | Surface Tension[mN/m] January1998 | Surface Tension[mN/m] January1999 | Polarity[%] Jan. 99 | Polarity[%] Jan. 99 |
|---|---|---|---|---|---|---|---|---|---|---|---|---|
| 1/PET | 95 | 48 | – | 12 | – | – | – | 26 | 47 | 49 | 30 | 38 |
| 2/PET | 105 | 48 | 24 | – | – | – | – | 32 | 45 | 49 | 33 | 33 |
| 3/PET | 126 | 48 | 24 | – | – | – | – | 30 | 47 | 47 | 30 | 35 |
| 4/PET | 88 | 48 | 24 | 12 | – | – | – | 24 | 48 | 47 | 32 | 31 |
| 5/PET | 78 | 36 | 36 | 12 | – | – | – | 80 | 45 | 44 | 27 | 27 |
| 6/PET | 99 | 48 | 12 | – | – | – | – | 10 | 50 | 48 | 39 | 34 |
| 7/PET | 75 | 48 | 24 | – | – | – | – | 45 | 49 | 47 | 33 | 32 |
| 8/PET | 123 | 48 | 24 | – | – | – | – | 64 | 48 | 45 | 33 | 33 |
| 9/PET | 137 | 36 | 36 | 12 | – | – | – | 168 | 45 | 44 | 26 | 29 |
| 10/PET | 62 | 48 | 12 | 12 | – | – | – | 9 | 52 | 50 | 41 | 39 |
| 11/PET | 103 | 48 | 12 | 12 | – | – | – | 11 | 50 | 48 | 40 | 40 |
| 12/PET | 106 | 48 | – | 12 | – | 12 | – | 284 | 51 | 52 | 29 | 36 |
| 13/PET | 100 | – | 12 | 12 | 12 | – | – | 18 | 51 | 50 | 39 | 38 |
| 14/PET | 110 | 12 | – | 12 | 6 | – | – | 12 | 47 | 45 | 32 | 33 |
| 15/PET | 104 | 6 | 12 | 12 | 6 | – | – | 8 | 49 | 46 | 34 | 34 |
| 16/PET | 108 | 6 | 24 | 12 | 6 | – | – | 22 | 45 | 45 | 28 | 30 |
| 1/BOPP | 70 | 48 | 12 | 12 | – | – | – | 10 | 52 | 52 | 42 | 42 |
| 2/BOPP | 60 | 48 | 12 | 12 | – | – | – | 11 | 51 | 51 | 42 | 42 |
| 17/PET | 100 | – | 12 | 12 | – | – | 48 | 27 | – | 58 | – | 60 |
| 18/PET | 250 | – | 12 | 12 | – | – | 24 | 35 | – | 53 | – | 55 |
| 19/PET | 200 | – | 24 | 12 | – | – | 24 | 46 | – | 45 | – | 41 |
| 20/PET | 120 | 24 | 12 | 12 | – | – | 24 | 25 | – | 54 | – | 43 |
| 21/PET | 130 | 12 | 12 | 12 | – | – | 24 | 18 | – | 63 | – | 65 |
| 22/PET | 115 | 24 | 12 | 12 | – | – | 24 | 16 | – | 56 | – | 50 |
| 12 μm PET-Film | | | | | | | | | 42.0 | | 7 | |
| 20 μm BOPP-Film | | | | | | | | | 30.2 | | 3 | |

| Sample/Film | Power[W] | $CO_2$ [sccm] | $CH_4$ [sccm] | Ar [sccm] | $O_2$ [sccm] | $C_2H_2$ [sccm] | $NH_3$ [sccm] | Thickness [nm] | Surface Tension[mN/m] January1998 | Surface Tension[mN/m] January1999 | Polarity[%] Jan. 99 | Polarity[%] Jan. 99 |
|---|---|---|---|---|---|---|---|---|---|---|---|---|
| 1/PET | 95 | 48 | – | 12 | – | – | – | 26 | 47 | 49 | 30 | 38 |
| 2/PET | 105 | 48 | 24 | – | – | – | – | 32 | 45 | 49 | 33 | 33 |
| 3/PET | 126 | 48 | 24 | – | – | – | – | 30 | 47 | 47 | 30 | 35 |
| 4/PET | 88 | 48 | 24 | 12 | – | – | – | 24 | 48 | 47 | 32 | 31 |
| 5/PET | 78 | 36 | 36 | 12 | – | – | – | 80 | 45 | 44 | 27 | 27 |
| 6/PET | 99 | 48 | 12 | – | – | – | – | 10 | 50 | 48 | 39 | 34 |
| 7/PET | 75 | 48 | 24 | – | – | – | – | 45 | 49 | 47 | 33 | 32 |
| 8/PET | 123 | 48 | 24 | – | – | – | – | 64 | 48 | 45 | 33 | 33 |
| 9/PET | 137 | 36 | 36 | 12 | – | – | – | 168 | 45 | 44 | 26 | 29 |
| 10/PET | 62 | 48 | 12 | 12 | – | – | – | 9 | 52 | 50 | 41 | 39 |
| 11/PET | 103 | 48 | 12 | 12 | – | – | – | 11 | 50 | 48 | 40 | 40 |
| 12/PET | 106 | 48 | – | 12 | – | 12 | – | 284 | 51 | 52 | 29 | 36 |
| 13/PET | 100 | – | 12 | 12 | 12 | – | – | 18 | 51 | 50 | 39 | 38 |
| 14/PET | 110 | 12 | – | 12 | 6 | – | – | 12 | 47 | 45 | 32 | 33 |
| 15/PET | 104 | 6 | 12 | 12 | 6 | – | – | 8 | 49 | 46 | 34 | 34 |
| 16/PET | 108 | 6 | 24 | 12 | 6 | – | – | 22 | 45 | 45 | 28 | 30 |
| 1/BOPP | 70 | 48 | 12 | 12 | – | – | – | 10 | 52 | 52 | 42 | 42 |
| 2/BOPP | 60 | 48 | 12 | 12 | – | – | – | 11 | 51 | 51 | 42 | 42 |
| 17/PET | 100 | – | 12 | 12 | – | – | 48 | 27 | – | 58 | – | 60 |
| 18/PET | 250 | – | 12 | 12 | – | – | 24 | 35 | – | 53 | – | 55 |
| 19/PET | 200 | – | 24 | 12 | – | – | 24 | 46 | – | 45 | – | 41 |
| 20/PET | 120 | 24 | 12 | 12 | – | – | 24 | 25 | – | 54 | – | 43 |
| 21/PET | 130 | 12 | 12 | 12 | – | – | 24 | 18 | – | 63 | – | 65 |
| 22/PET | 115 | 24 | 12 | 12 | – | – | 24 | 16 | – | 56 | – | 50 |
| 12 μm PET-Film | | | | | | | | | 42.0 | | 7 | |
| 20 μm BOPP-Film | | | | | | | | | 30.2 | | 3 | |

FIG. 1

POLAR POLYMERIC COATING

The present invention concerns a process for coating of substrates by means of plasma polymerisation. The invention also concerns a coating, produced using the process, of a polymer substrate and applications of the process.

Polymer substrates such as in particular flexible substrates are coated amongst other reasons in order to influence the surface composition or appearance of the polymer or protect the surface mechanically, physically and chemically. This may be to increase the adhesion to the surface or the printability, to prepare the surface for further functional coatings, to ensure protection against abrasion or damage, to reduce or prevent the permeability of certain gases or liquids on or through the surface of the substrate, or to increase the chemical resistance of the substrate to certain chemicals.

For surface treatment of polymer substrates which increases the polarity or surface tension in the short term, a multiplicity of methods are known where in principle two processes occur most commonly: modification of the surface for example by a corona discharge at atmospheric pressure or by a plasma process at reduced pressure.

Both said processes are important in particular in connection with the increase in adhesion to the polymer substrate or the increase in printability. However, in corona discharge it has been found that the printability for example of polymer packing films is good only immediately after performance of the treatment and the printability diminishes again after just a few hours or days.

In contrast, in a series of documents it is proposed to modify or coat the polymer by means of a low pressure plasma process, where the coating is usually hydrophilic and allows good adhesion or printability. This printability is retained practically without restriction because of the coating.

Thus for example in JP-59-15569 and WO, A1AU89/00220 it is proposed to coat a polymer substrate by means of plasma polymerisation of an organic compound, together for example with a working gas and water or water vapour. It is also proposed in WO95/04609 to treat or coat the surface by means of plasma polymerisation of an organic compound in the presence of hydrogen peroxide.

U.S. Pat. No. 3,397,132 concerns a coating of metal surfaces, where an electric discharge occurs in the presence of organic gases and an inert carrier gas. With regard to the inorganic gases, the absence of water is neither mentioned nor otherwise stated as essential. In contrast, precise statements are made for other parameters such as pressure, temperature, concentration, voltage and frequency. Corresponding modifications to the parameters achieve the desired improvements in the metal surfaces by plasma coating.

In a polar plasma coating to DE, A1 3908418, at least one organic compound and an optional inorganic gas is used. Plastic containers are coated on the inside with coatings impermeable to organic solvents, where the inside of the container is impacted with a low pressure plasma. This process too does not mention the absence of water.

Firstly, the coatings proposed in the state of the art have a poor adhesion to the substrate, or they have restricted wettability. The use of peroxide or water and oxygen causes a problem as the resulting "working gas" is aggressive and can attack the surface of the substrate (etching).

BRIEF DESCRIPTION OF THE DRAWINGS

FIG. 1 A table illustrating the properties of two polar polymer-like plasma coatings of the present invention.

Figure 2A:
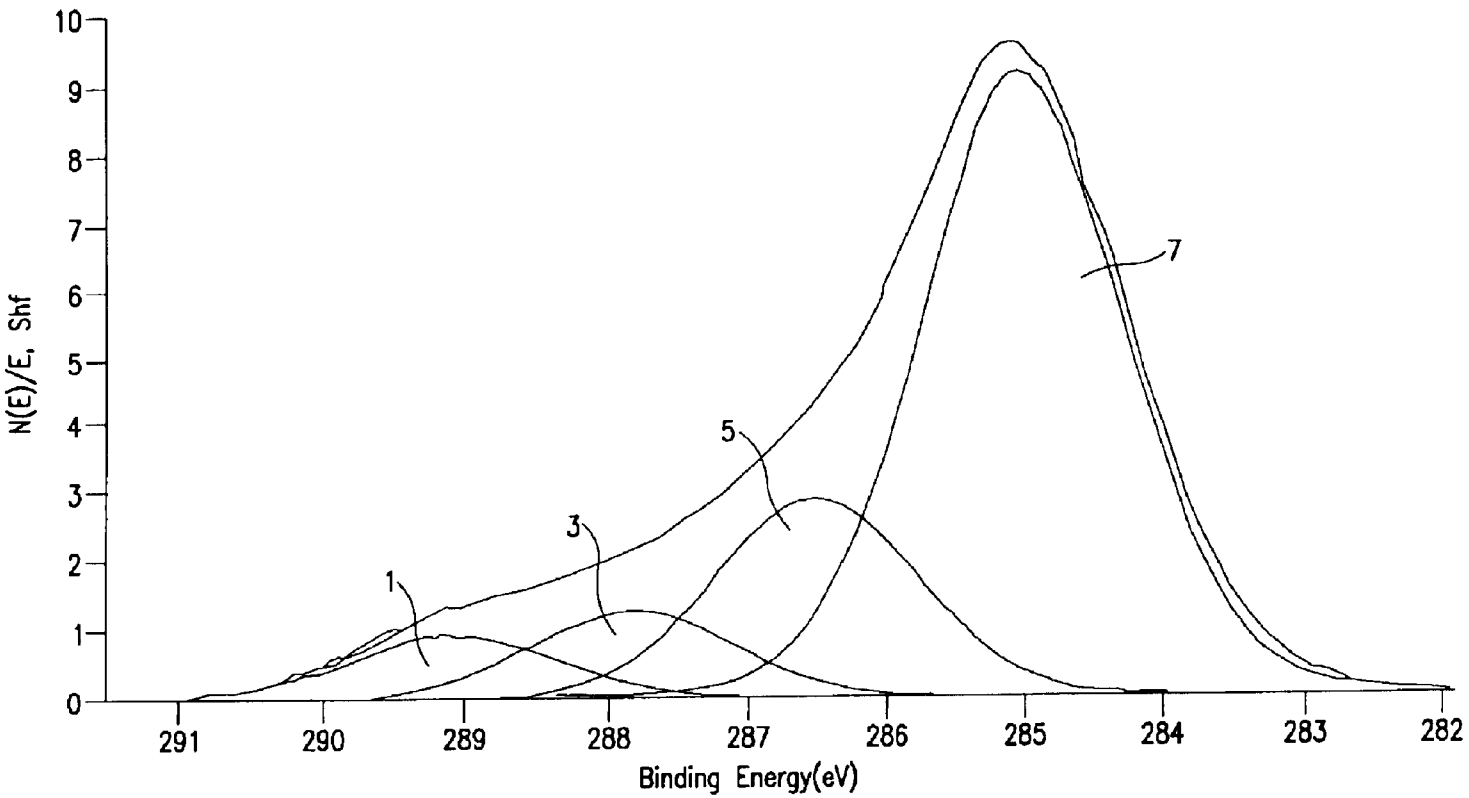
FIG. 2*a* An illustration of the chemical structure of the hydrophilic layer showing the X-ray photo-electron spectroscopy of sample 8/PET in FIG. 1.

It is therefore a task of the present invention to propose a process for polar coating of substrates by means of plasma polymerisation which does not have the present disadvantages. A coating produced with the process and applications are also proposed.

With reference to the process, the task according to the invention is solved with the features according to claim 1.

The hydrocarbon compounds which have up to a maximum of eight carbon atoms are therefore of relatively low molecular weight, so the compounds have a relatively high vapour pressure at room temperature.

Preferred substances are alkanes, alkenes, alkynes (acetylene), polyenes, monovalent or multivalent alcohols, carboxylic acids, ethers, aldehydes and/or ketones. These can be aliphatic, cycloaliphatic or aromatic hydrocarbon compounds.

The use of water vapour as a process gas in a gas discharge is anything but ideal and must be avoided according to the invention. Furthermore, a water-containing layer would have a lower chemical and thermal resistance which would have negative effect on the subsequent process stages and the definition and stability of the coatings. The plasma-polymerised coating according to the invention is therefore water-free and so compact that although hydrophilic it absorbs almost no water in further processing.

For this reason in each case it is essential for the invention that the process gas used for plasma polymerisation or the working gas is free from water or water vapour. The absence of water or water vapour at least in the process gas in any case ensures that the working gas or gas mixture contains no peroxide compounds which could for example form in the plasma chamber if water and oxygen are used.

Merely by the simultaneous use of oxygen and hydrogen in the process gas, or oxygen- and hydrogen-containing compounds such as for example ethanol or methanol, is it possible for water vapour or peroxide to form during the process, but only traces of these components which usually do not have a negative effect on the coating. Also the formation of water vapour or peroxide can be predicted and controlled and thus limited.

A comparison with the known coatings for example from the three said documents from the state of the art, shows such a high hydrophility of the coatings on the polymer substrate that a substantially better printability is achieved. This is achieved even after storage of at least six months. It is assumed that this improvement in the properties of the coating proposed according to the invention is attributable to the circumstance that the process gas used in the process according to the invention is free from water or water vapour.

In principle all known plasma processes such as for example microwave discharge, high or low frequency discharge, DC magnetron discharge, arc vaporisation, the use of electron guns etc. are suitable for the performance of the process according to the invention. The process proposed according to the invention is also suitable for coating all known polymer substrates used today, for example for the production of packing materials such as polyethylene, polyamide, polypropylene, PMMA, PVC, polyesters such as PETP, PBTP, polymide, polycarbonate etc. It is also possible to coat metal and ceramic substrates. The polar coating can then serve as a coupling agent between these materials and further coatings such as for example corrosion protection coatings, or allow the connection of different materials such as for example metal/polymer etc.

By means of the process proposed according to the invention, the said polymer substrate is given a polar polymer-like coating or a plasma coating with high surface tension in which are integrated polar groups such as for example hydroxyl, carboxyl, carbonyl groups (see FIGS. 2*a* and 2*b*) or $NO_X$ groups, whereby on the surface of this coating an excellent adhesion can be achieved for polar functional layers and/or polar materials, which is reflected for example in an excellent printability. In particular packaging materials, films, containers, bottles made from the said polymer substrates can thus be processed considerably more easily. Usually a coating of the order of a few nm is sufficient to achieve this increased adhesion and printability.

As already stated, for performance of the proposed process, all low pressure plasma processes known and commonly used today can be used, so detailed description of these processes can be omitted at this point. The substrate to be coated, flexible for example, such as a film, hollow body or similar, is placed in a vacuum chamber into which is introduced the working gas consisting of the said components. As already stated it is essential that this working gas is free from water or water vapour or moisture. Then by means of the plasma process a plasma-polymerised coating is deposited on the surface of the material to be coated.

It is also possible to coat a granulate or powder according to the invention and then produce a polar film or body from this (Ref. 2).

The coating thus generated by plasma-polymerisation usually has a layer thickness of a few nm, for example between 1 and 100, preferably 5 to 20 nm; but it can also amount to a few $\mu$m. Evidently the layer thickness depends on the requirements, whether in addition to the printability a scratch protection or anti-fog effect is required, to which the coating achieved according to the invention can also make a contribution.

Also the ratio between the inorganic gas components such as for example oxygen, nitrogen, ammonia or carbon monoxide or carbon dioxide, and the organic compound, depends on the properties required for the coating. The ratio can vary greatly depending on the components contained in the gas mixture or working gas. FIG. 1 illustrates two examples. In addition to the said components, naturally further constituents such as in particular inert gases for example argon or helium etc., can be used.

Suitable organic compounds are in particular alkanes with a chain length of up to around eight carbon atoms such as for example methane, ethane, propane etc. Also alkenes such as ethylene, propylene etc. are suitable as organic compounds.

Also suitable are acetylenes or acetylene-based compounds such as so-called alkynes.

Equally suitable are polyenes, i.e. hydrocarbons with several double bonds, again with up to around eight carbon atoms.

Also suitable are alcohols such as methanol, ethanol, propanol etc. and multivalent alcohols such as for example ethylene glycol.

Also suitable are monovalent or multivalent organic acids, ethers, aldehydes and ketones. The hydrocarbon compounds stated can be aliphatic, cycloaliphatic or aromatic hydrocarbons, where naturally all the said compounds can also be substituted such as for example by amino groups, halogens, ammonia etc.

The present invention will now be explained in more detail using the examples below:

Examples: stable hydrophilic surfaces by plasma-polymerised functional coating with polar groups:

At a basic pressure of for example lower than $3\times10^{-6}$ mbar, a plasma reactor is flooded with the process gas mixture until the required process pressure is achieved, for example $1.6\times10^{-2}$ mbar. In the present examples a microwave discharge (2.45 GHz) was then ignited while the process gases were supplied continuously. A coating with a polar proportion of 41% and a surface tension of 50 mN/m was achieved with a gas mixture of 48 sccm (standard cubic cm per minute) C02, 12 sccm CH4 and 12 sccm Ar with a microwave power of 62 Watts (specimen 10/PET). The substrate was a 12 $\mu$m thin PET film or a 20 $\mu$m thin polypropylene film (specimen 2/BOPP), representative of polymer substrates. An increase in process pressure up to atmospheric pressure leads to a high deposition rate and is presently the state of optimisation of coatings. FIG. 1 also shows that by varying the power and process gas mixture, the required surface tension for the corresponding substrate can be achieved. Comparison of the various gas mixtures in FIG. 1 shows that the gas mixture has a greater influence on the hydrophility than varying the power supplied to the plasma by 80 Watts. FIG. 1 shows the coatings which were produced between July and October 1997 and for which the surface tension was again measured in January 1998 and 1999.

Figure 3:
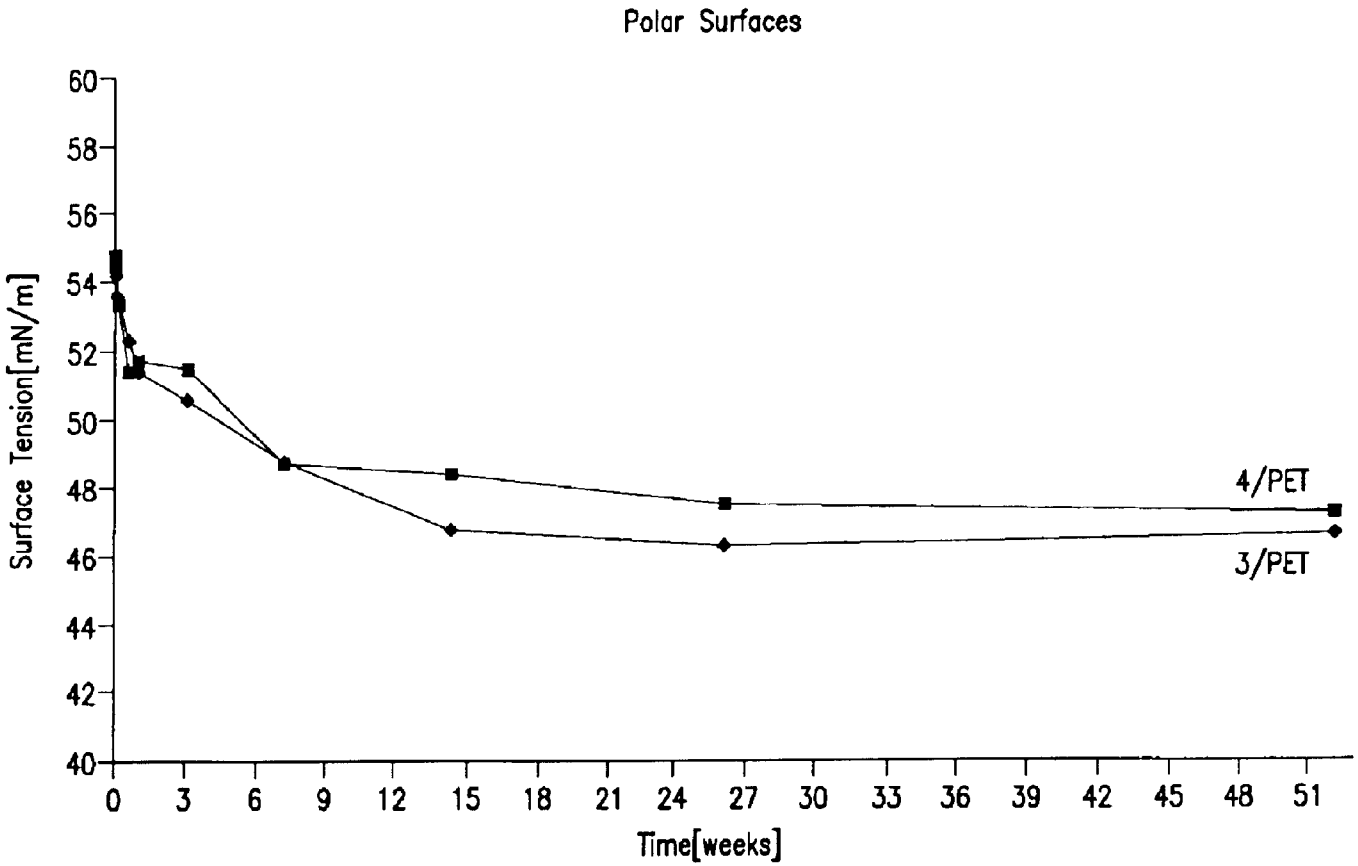
FIG. 3 An illustration of the surface tension of samples 3/PET and 4/PET in FIG. 1.

After 12 weeks, in no coating was a total surface tension of less than 45 mN/m measured, which is of decisive importance for the subsequent process stages in production. Specimen 1/PET was produced on 16th Jul. 1997, where the surface tension after 6 months was still 47 mN/m and after 18 months 49 mN/M. In contrast, with corona treatment and surface modification with low pressure plasmas (with process gases containing oxygen and/or nitrogen), after a few weeks no such high surface tension was measured. According to literature the plasma-modified surface is restructured in the first three weeks following treatment (Ref. 1). As the stability of the hydrophilic layer was monitored for more than 18 months, it can safely be assumed that a stable state has been achieved as the surface tension and polarity values of the coatings after around two months were only insignificantly modified, as is shown for example from FIG. 3.

Figure 2B:
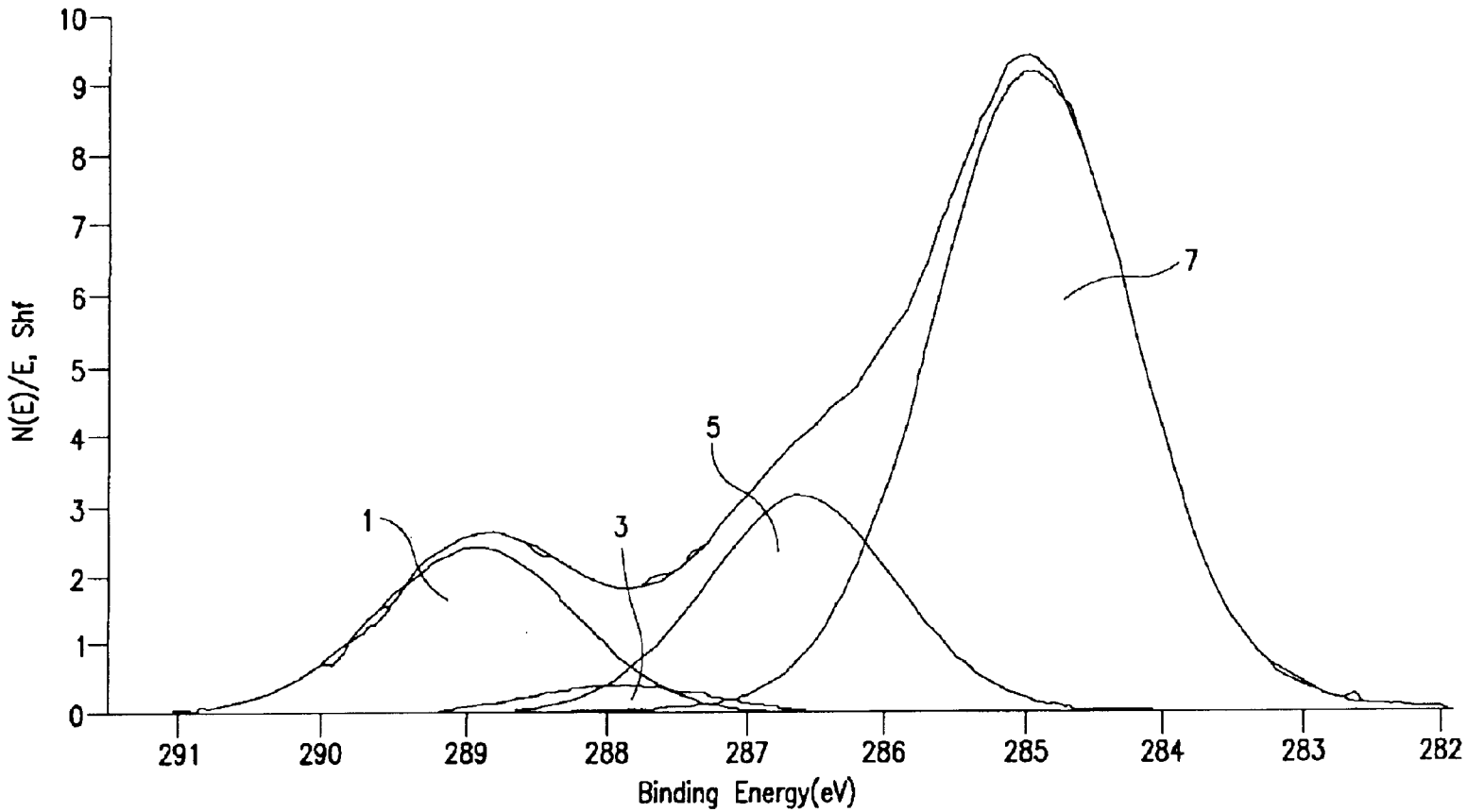
FIG. 2b An illustration of the chemical structure of the hydrophilic layer showing the X-ray photo-electron spectroscopy of sample 10/PET in FIG. 1.

The chemical structure of the hydrophilic layers is clear from the enclosed FIGS. 2*a* and 2. The two FIGS. 2*a* and 2*b* show the XPS spectra (=X-ray photo-electron spectroscopy) of C (1s), specimens 8 and 10 (PET) on table FIG. 1. The surface areas shown in FIGS. 2*a* and 2*b* are representative of the following bonds: 1 for O—C═O, 3 for C═O, 5 for C—O, 7 for C—H. C—O bonds are present in alcohol and ether, C═O in ketones and aldehydes and O—C═O in esters and carboxylic acids. The standardized numbers of count N (E) are shown in function of the binding energy (eV).

In FIG. 2*a* the area proportion of 1 is 6.5%, the area proportion of 3 is 8.9%, the proportion of 5 is 20.1% and the proportion of 7 is 64.5%. The total proportion of carbon is 76.2% and that of oxygen 23.8%. The ratio of carbon to oxygen is therefore 76.2:23.8.

In FIG. 2*b* the area proportion of 1 is 15.4%, the area of 3 is 2.6%, the area of 5 is 20.0% and the area of 7 is 61.9%. The proportion of C (1s) is 70.0% and the proportion of 0 (1s) is 30.0%.

The XPS (X-ray photo-electron spectroscopy) results show that the polar surface of the specimen 10/PET in comparison with specimen 8/PET contains 6 at% more oxygen and this is present mainly in ester and carboxylic compounds. (Hydrogen cannot be detected with this method). In both specimens (8/PET and 10/PET) one-fifth of the oxygen is bonded as alcohol or ether. The higher polarity (polar proportion/total surface tension) of 41% (specimen 10/PET) in contrast to 33% (specimen 8/PET) is consequently due to a higher oxidation of the carbon atoms (O—C═O).

By means of the process described above as an example, a series of PET and BOPP films were coated, the total surface tension and polarity of the coatings of which were then determined. The coating parameters and results of the measurements are summarised in the table 1 below.

PET: Polyethylene terephthalate film 20 $\mu$m thick

BOPP: Biaxial-oriented polypropylene 20 $\mu$m thick

The wettable of all samples or coatings listed in FIG. 1 is between 20 and 63 mN/m (to DIN-EN 828 (draft)). In relation to the examples of generated coatings summarized in FIG. 1, it is important to emphasise that the coatings generated in this way remain polar. As has been proven, these remain polar for at least twelve months from which it can presumably be concluded that these coatings remain stable for years.

The test conditions described as examples above serve merely to explain in more detail the basic concept of the present invention. Naturally it is also possible to produce plasma-polymerised coatings according to the process defined in the invention under widely varying conditions and on very different substrates. The coating (any functional coating which is polar in nature), printing, laminating (adhesion-gluing to polar adhesives) is possible on such a polar surface for new printing agents and adhesives based on the solvent water. In order to stabilise the surface tension, doping of the coating with inorganic anions (nitrogen, fluorine etc.) and inorganic cations (metals or metal oxides) is also permitted. Thus further properties, e.g. the electrical conductivity of the coating, can be adjusted as required for the product.

It is essential for the invention that the working gas used for plasma polymerisation is free from water and water vapour and moisture.

(Ref. 1): Thomas R. Gengenbach et al., "Concurrent Restructuring and Oxidation of the Surface of n-Hexane Plasma Polymers During Ageing in Air", Plasmas and Polymers, Vol. 1, No. 3, 1996, p. 207–228.

(Ref. 2): J. Messelh.user, S. Berger, "Plasma Modification of Powdery Plastics", 7th Federal German Seminar, 13th–14th Mar. 1996, Rub-Bochum, p. 39 ff.

What is claimed is:

1. Process which comprises: coating substrates with a polar coating, wherein the coating takes place by means of plasma polymerization; including the step of employing a water-free process gas which contains at least one substituted hydrocarbon compound with up to a maximum of 8 C-atoms and also an inorganic gas, to produce a coating which is stable in the long term; and wherein said coating step further comprises coating at least one of packing materials and substrates for adhesion of composite materials.

2. Process according to claim 1, wherein said packing materials consist of at least one of films, bottles and containers.

3. Process which comprises: coating substrates with a polar coating, wherein the coating takes place by means of plasma polymerization; including the step of employing a water-free process gas which contains at least one substituted hydrocarbon compound with up to a maximum of 8 C-atoms and also an inorganic gas, to produce a coating which is stable in the long term; and including the step of coating at least one of ceramic and metal substrates.

4. Process which comprises: coating substrates with a polar coating, wherein the coating takes place by means of plasma polymerization; including the step of employing a water-free process gas which contains at least one substituted hydrocarbon compound with up to a maximum of 8 C-atoms and also an inorganic gas, to produce a coating which is stable in the long term; and including the step of coating at least one of polymer flexible substrates, polymer substrates reinforced with ceramic fibers, glass fibers, polymer fibers and carbon fibers, and powder- or granulate-formed substrates, and producing one of a polar film and a polar molded body.

* * * * *